US009339719B2

(12) United States Patent
Brown et al.

(10) Patent No.: US 9,339,719 B2
(45) Date of Patent: May 17, 2016

(54) SKI BINDING PLATE

(71) Applicants: Christopher A. Brown, Cazenovia, NY (US); John M. Madura, Hewitt, NJ (US)

(72) Inventors: Christopher A. Brown, Cazenovia, NY (US); John M. Madura, Hewitt, NJ (US)

(73) Assignee: Worcester Polytechnic Institute, Worcester, MA (US)

( * ) Notice: Subject to any disclaimer, the term of this patent is extended or adjusted under 35 U.S.C. 154(b) by 0 days.

(21) Appl. No.: 14/449,427

(22) Filed: Aug. 1, 2014

(65) Prior Publication Data

US 2015/0061262 A1 Mar. 5, 2015

Related U.S. Application Data

(60) Provisional application No. 61/861,162, filed on Aug. 1, 2013.

(51) Int. Cl.

| | |
|---|---|
| ***A63C 9/081*** | (2012.01) |
| ***A43B 5/04*** | (2006.01) |
| ***A63C 9/084*** | (2012.01) |

(52) U.S. Cl.

CPC . *A63C 9/081* (2013.01); *A43B 5/04* (2013.01); *A63C 9/084* (2013.01); *A63C 9/0844* (2013.01)

(58) Field of Classification Search

CPC ..... A63C 9/08; A63C 9/0805; A63C 9/081; A63C 9/082; A63C 9/084; A63C 9/085; A63C 9/044

USPC ..... 280/611, 613, 614, 618, 626, 628

See application file for complete search history.

(56) References Cited

U.S. PATENT DOCUMENTS

| | | | | |
|---|---|---|---|---|
| 4,003,587 | A | 1/1977 | Salomon | |
| 4,135,735 | A | 1/1979 | Beyl | |
| 4,230,338 | A | 10/1980 | Weigl et al. | |
| 4,512,594 | A * | 4/1985 | Eyre | A63C 9/001 280/614 |
| 4,526,397 | A * | 7/1985 | Richert | A63C 9/003 280/612 |
| 4,893,831 | A | 1/1990 | Pascal et al. | |
| 5,213,356 | A * | 5/1993 | Rohrmoser | A63C 9/00 280/607 |
| 5,362,088 | A * | 11/1994 | Rohrmoser | A63C 9/08 280/625 |
| 7,810,833 | B2 * | 10/2010 | Ettlinger | A63C 9/003 280/617 |
| 2012/0007338 | A1 * | 1/2012 | Moran Adarraga | A63C 9/0802 280/617 |

OTHER PUBLICATIONS

International Search Report, PCT/US2014/049356, 2 pages, dated Apr. 6, 2015.

* cited by examiner

*Primary Examiner* — John Walters
(74) *Attorney, Agent, or Firm* — Chapin IP Law, LLC

(57) ABSTRACT

A ski binding device having a plate adapted to engage the ski binding, in which the plate has a heel end and a toe end, and a heel absorption mechanism is adapted to absorb excessive lateral pivoting force from the heel of a ski boot. A restrictor biases the heel into engagement with a heel receptacle. A dual pivot engages the toe end of the plate for permitting both downward movement of the heel end and lateral movement of the heel end out of alignment with the ski. The lateral pivoting force corresponds to release of potentially harmful forces. The restrictor is responsive to upward force from the toe end, as results from disproportionate backweighting of a skier. The restrictor disengages the heel end from the heel receptacle based on a predetermined release force, and permit lateral outward displacement of the heel end upon disengagement of the heel.

21 Claims, 9 Drawing Sheets

SKI BINDING PLATE

RELATED APPLICATIONS

This patent application claims the benefit under 35 U.S.C. §119(e) of U.S. Provisional Patent App. No. 61/861,162, filed Aug. 1, 2013, entitled "SKI BINDING PLATE," incorporated by reference in entirety.

BACKGROUND

Ski bindings prevent ski injuries by releasing the skier's leg from rigid communication with the ski when forces deemed to be injurious are applied to the ski, as in a ski fall. Typically, rotation of the ski boot out of alignment with the toe of the ski occurs from pivoting movement of the toe binding. The toe binding is set to retain the boot in alignment with the ski until a predetermined force, and when a twisting or rotation exceeding the predetermined force occurs, the binding pivots right or left to allow the boot to fall out of the ski, presumably from a downed skier rolling or tumbling across the snow surface. The threshold release force, however, needs to be identified and calibrated in order to prevent premature release from normal skiing movements that mimic the harmful forces

SUMMARY

A ski binding plate interfaces between a ski and conventional ski binding for providing an alternate release mechanism for injurious forces that can elude conventional ski bindings, specifically forces that tend to cause so-called Combined Valgus and Internal Rotation (CVIR) and Boot Induced Anterior Drawer (BIAD) injuries, both concerned with Anterior Cruciate Ligament (ACL) damage. Combined Valgus and Internal Rotation injuries commonly occur when a skier is excessively back-weighted, and is characterized by forces that force the knee into a valgus position combined with an internal rotation. Boot Induced Anterior Drawer injuries typically result from forces such as that incurred from an aerial maneuver (i.e. jump) resulting in a back leaning landing such that the rear tips of the skis contact first, and the skier's weight tends to "slap" the front tips down with substantial force. This action causes sudden rotation and pulling force to be transferred to the knee region of the skier. Configurations disclosed below accommodate and absorb such forces by a disengageable heel biased out of engagement by a threshold downward force to permit rotation about a double pivoted toe, and by a toe release biased for a predetermined upward force that permits hinged upward tow movement away from the ski.

Configurations herein are based, in part, on the observation that skiing focuses a substantial force on the skier's leg from the effective leverage based on the ski length. Unfortunately, conventional ski bindings suffer from the shortcoming that the safety release mechanisms are focused on rotation at the toe, and remain fixed in response to other forces, such as backweighting, which can also generate harmful forces. Accordingly, configurations herein substantially overcome the shortcomings of conventional bindings by detecting a backweighting situation that leaves the knee open to harmful twisting at the ankle/boot juncture, and allows an outward pivot of the heel around a toe pivot point. In contrast to conventional approaches that release the toe to pivot outwards, backweighting beyond a threshold force releases a restrictor holding the heel fixed, and allows the heel to rotate around a fixed toe pivot. Backweighting is sensed by relative displacement of the toe to the heel, and movement beyond a threshold resistance force releases the heel. Backweighting may also be sensed by relative displacement of the heel to the toe.

The ski binding plate is designed to reduce the number of Anterior Cruciate Ligament injuries in alpine skiers. Most ACL injuries occur when the skier is in a back weighted unbalanced position. The binding plate senses when the skier is in a back weighted position to activate an ACL saving mechanism. This binding plate absorbs the injurious energy through a lateral rotation of the binding plate about a point located underneath the toe piece of the binding. The energy is absorbed through a mechanical system that detects backweighting forces and selectively releases the heel to pivot outward at the toe point for relieving "twisting" forces that can cause ACL and other knee injuries. The energy absorbed can lead to injuries known as the Combined Valgus and Internal Rotation ACL injuries. After the system has absorbed all the energy it is capable of, the binding may release the boot from the ski if the injurious load is still present.

This binding plate also has the ability to absorb energy which may lead to Boot Induced Anterior Drawer ACL injuries. This is accomplished through a posterior rotation in the vertical direction about the heel of the ski binding.

Conventional, spring based release mechanisms tend to follow a progressive force/displacement curve, because the spring exerts increasing force as the displacement moves away from a rest position (either compression or extension). Thus, a spring based system requires the least amount of energy to begin responsive movement, and the required energy to continue the movement increases. Configurations herein exhibit a flat or inversely progressive force vs. displacement curve to avoid excessively high engagement or release threshold. Concerns over a low engagement threshold of a release mechanism often cause conventional approaches to set excessively high engagement thresholds. This engagement threshold must be reached before mitigation of the harmful force, but a progressive tension as with a conventional spring further increases the force that needs to be applied after the engagement threshold is reached. The inversely progressive curve continues displacement at a lower force than that required to initiate displacement.

Configurations discussed below, therefore, include a ski binding plate having a plate adapted to engage the ski binding, in which the plate has a heel end and a toe end, and a heel absorption mechanism is adapted to absorb excessive lateral pivoting force from the heel of a ski boot. A heel receptacle is adapted to engage the heel end, and a vertical displacement moderator biases the heel into engagement with a heel receptacle. A dual pivot engages the toe end of the plate for permitting both downward movement of the heel end and lateral movement of the heel end out of alignment with the ski. The lateral pivoting force corresponds to release of forces tending to result in Combined Valgus and Internal Rotation injury. In the example arrangement, the vertical displacement moderator is responsive to downward force from the heel end toward the ski, such that the downward force results from disproportionate backweighting of a skier, in which the vertical displacement moderator disengages the toe end from the toe receptacle based on a predetermined release force. The dual pivot is responsive to permit lateral outward displacement of the heel end upon disengagement of the heel end, such that the heel end is engaged with the heel receptacle when biased by the vertical displacement moderator (i.e. upward into engagement during normal skiing or at-rest situations). The vertical displacement moderator permits lateral movement once the plate is released from the heel receptacle, such as by downward heel force from excessive back loading. The vertical displacement monitor disposes the heel end into engagement with the heel receptacle and is adapted to selectively disengage the heel end upon a predetermined release threshold of force applied to the heel toward the ski. Depending on configuration, the vertical displacement moderator may be defined by an assembly of a spring, hydraulic, pneumatic, or resilient material adapted to provide the predetermined release threshold. In particular configurations, the vertical displacement moderator is adapted to exhibit a nearly flat, or decreasing, force vs. displacement response curve, in contrast to conventional spring tension release bindings.

The plate is adapted to engage a conventional ski binding at a toe and a heel end, in which the binding plate is secured to a ski boot such that release operation of the ski binding is not impeded. The plate further may further include a bottom plate hingedly attached to the top plate via a hinge disposed at a heel end of the binding plate, and the toe end is adapted to selectively disengage according to a predetermined force of the ski away from the toe end.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Configurations discussed below demonstrate an example configuration for illustrating the principles and techniques employed herein for a method and apparatus to mitigate ACL and other twisting and/or torsion based injuries resulting from backweighting distribution of a skier. The general principles illustrated may be implemented by various configurations without departing from the disclosed concept for heel based release responsive to backweighting force. Several example implementations are illustrative, as shown below.

Figure 1:
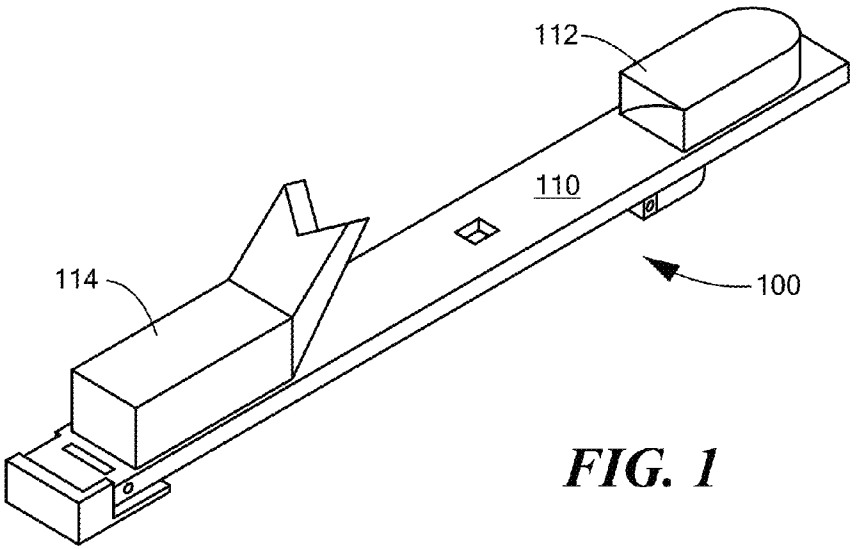
FIG. 1 shows a context view of the binding plate device in conjunction with a ski binding.

FIG. 1 shows a context view of the binding plate device 110 in conjunction with a ski binding. Referring to FIG. 1, the binding plate device 110 (plate) is operable in conjunction with a conventional ski binding, which typically includes a binding toe 112 (toe) and binding heel 114 (heel). The plate 110 is shown with the bindings 112, 114 attached to the plate 110, but the plate may also be deployed between the bindings 112, 114. In operation, the bindings 112, 114 secure a ski boot, and the bindings 112, 114 and plate 110 combination attach the ski boot in releasable communication to a ski. The selective release in response to detected harmful movements occurs cooperatively and independently of the native binding release mechanism such that either provides a release to protect the skier from injury due to unnatural or harmful leg movements. Thus, either the plate 110 or the bindings 112, 114 may release and will free the boot and skier. In this manner, the disclosed configuration provides enhanced release safety without diminishing or interfering with safety release mechanisms already inherent in the bindings 112, 114.

Figure 2:
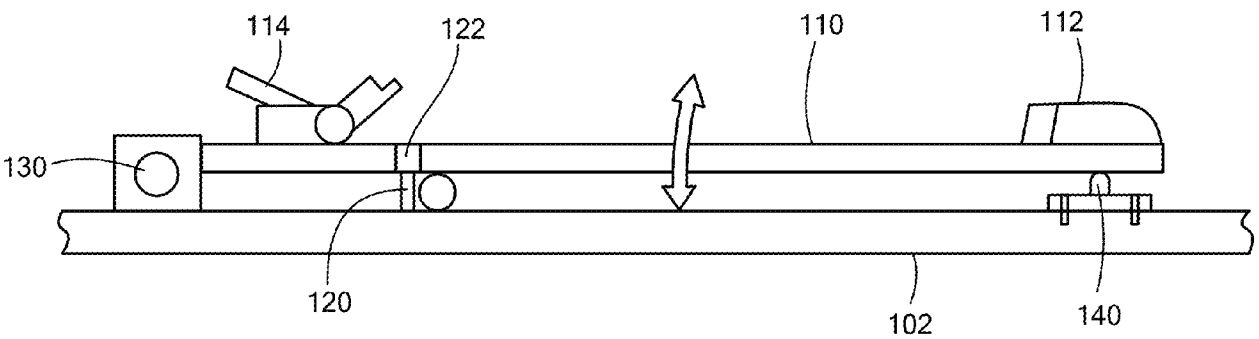
FIG. 2 shows a side view of the device of FIG. 1.

FIG. 2 shows a side view of the device of FIG. 1. Referring to FIGS. 1 and 2, the plate 110 mounts on a ski 102 via a front toe pivot 140 and a rear restrictor 130 (restrictor), which operates as a release and absorption device for absorbing loads below an injury threshold, and permitting displacement and release once the absorbed load exceeds the injury threshold, discussed further below in FIG. 5. A spring 120 or similar resilient member is responsive to forces related to backweighting, and displaces accordingly. In the example of FIG. 2, the spring 120 is resistive to downward displacement of the heel 114 up to a release threshold, which is lower than the injury threshold (the point at which skier injury occurs due to excessive ankle and knee forces). In general, the backweighting condition generates forces tending to pull the toe 112 up and force the heel 114 down; relative displacement of either the heel or toe is employed to sense and detect a backweighting condition. In the example of FIGS. 1-4, the restrictor 130 identifies downward heel 114 movement against the upward force of the spring 120 up to a point defined by the release threshold, at which point the heel is released to pivot around the toe pivot 140, discussed further below.

In the general configuration shown in FIG. 1, the ski binding device includes a boot pivot adapted to permit pivotal movement of a ski boot relative to a top surface of the ski 102, in which the boot has a heel and a toe. A restrictor 130 is operable to restrict lateral movement of the boot until a predetermined pivot displacement has been attained. The boot pivot 140 permits vertical displacement of the heel 114 relative to the toe 112 in response to a backweighting condition, typically ignored by conventional bindings which fix the heel 114 in a rigid downward engagement to the ski 102. In response to a backweighting condition, toe pivot 140 allows outward pivotal movement of the heel 114 of the boot following displacement of the toe 112 beyond the predetermined pivot displacement while maintaining attachment to the ski 102. The restrictor 130 is configured to release the boot for outward pivot of the heel 114 around the toe 112 upon sufficient pivotal movement of the toe 112 relative to the heel 114, generally meaning that the heel 114 biases downward or the toe 112 biases upward in response to the backweighting distribution of skier weight.

Figure 3:
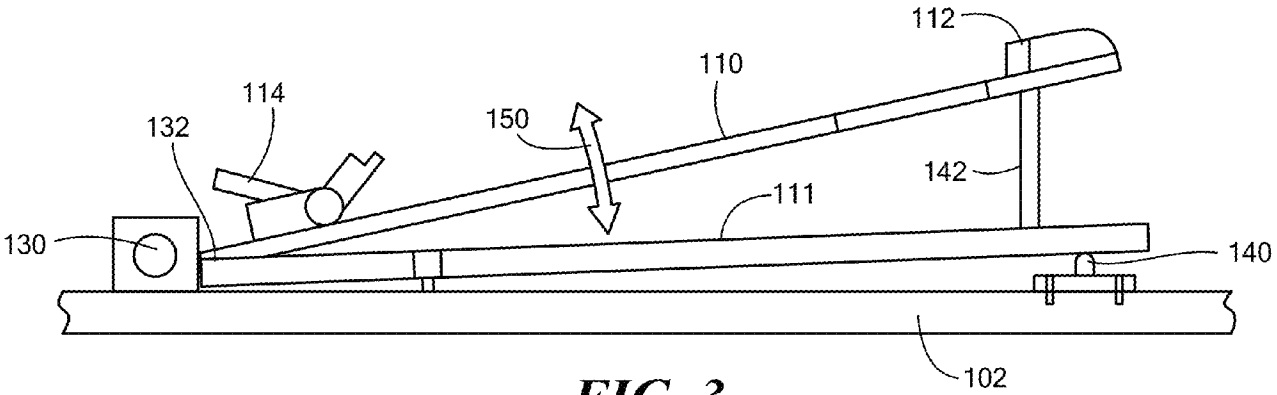
FIG. 3 shows the device of FIG. 2 in a partially deployed position.

FIG. 3 shows the device of FIG. 2 in a partially deployed position. Referring to FIGS. 2 and 3, upon experiencing a backweighting condition, the toe 112 rises relative to the heel 114 above the ski 102 surface via a horizontal pivot 132. As pivoting angle 150 increases, a force transmittance structure 142 indicates vertical displacement and prevents complete detachment from the bottom portion 111.

Figure 4:
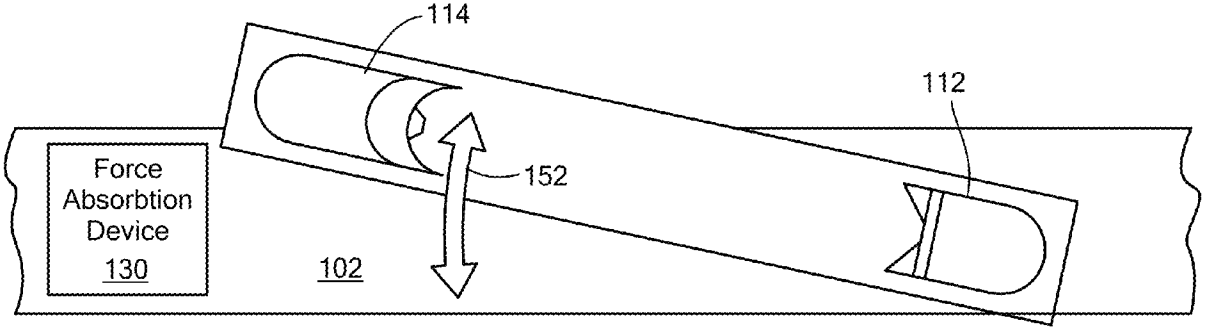
FIG. 4 shows the device of FIG. 3 deploying completely.

FIG. 4 shows the device of FIG. 3 deploying completely. Upon a backweighting condition exceeding the release threshold, as indicated by the pivoting angle 150, a pivotal release activates for permitting vertical pivoting around the toe pivot 140. In the example of FIG. 4, the restrictor 130 releases at the heel 114; release may also be at the toe as discussed further below (but still permitting outward heel displacement around the toe pivot 112), such that the toe 112 remains substantially fixed to the lower plate 111 and ski 102 assembly. The restrictor 130 further comprise a backweighting threshold, such that the restrictor 130 is adapted to detect a backweighting in excess of the backweighting threshold and release the boot heel 114 for lateral movement around the toe pivot 140 in response to the excess backweighting.

Figure 5:
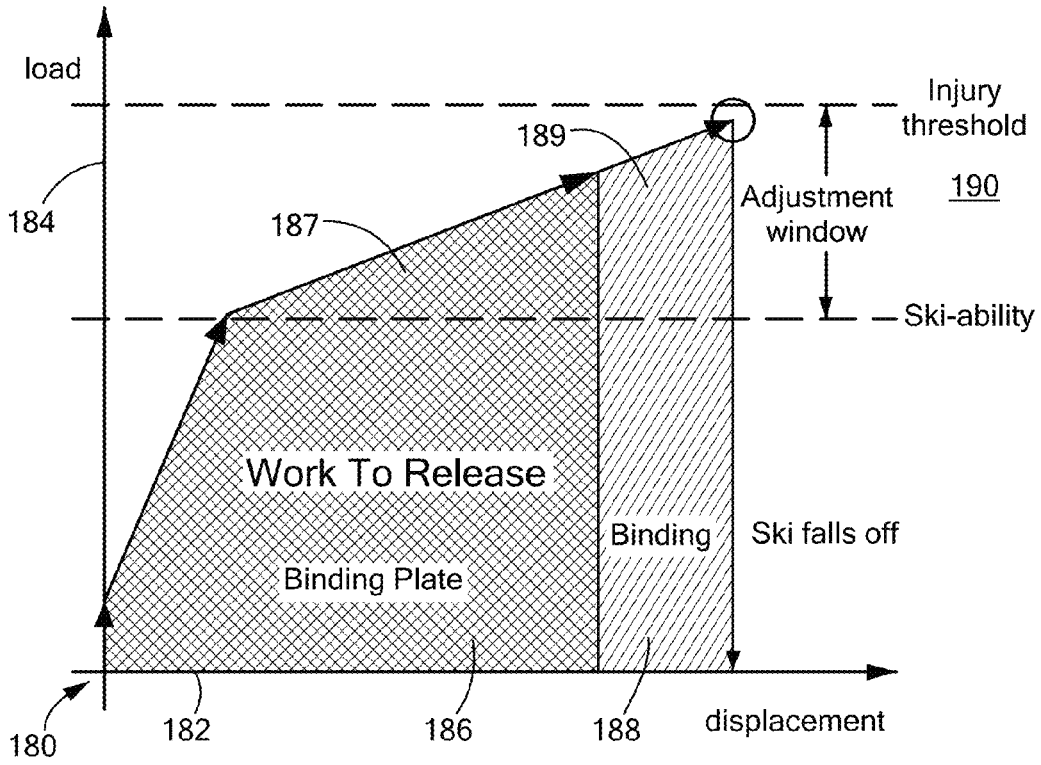
FIG. 5 shows a force/displacement graph for the device of FIGS. 1-4.

FIG. 5 shows a force/displacement graph for the device of FIGS. 1-4. Referring to FIG. 5, the forces transmitted from the skier to the boot/plate/ski assembly are plotted relative to the release provided by the system of the plate 110 and bindings 112, 114. A graph 180 plots the load 184 from forces on the boot to the displacement 182 of the boot. Since the bindings 112, 114 and plate 110 hold the boot in rigid engagement, boot displacement is equivalent to displacement of the plate 110. Further, since the plate 110 displacement generally triggers at a lower threshold (otherwise the bindings 112, 114 would tend to release before the plate 110), the bindings 112, 114 experience no significant displacement prior to plate 110 activity.

During ski activity, the binding plate 110 experiences force within the skiabiltiy window 186. Forces increase until they reach the ski-ability threshold and cross into the adjustment window 187. At this point, the binding plate has begun displacement (as in FIG. 3, and the force load is mitigated as the slope becomes more gradual. Since the plate 110 absorbs backweighting, and the bindings generally absorb torsion (twisting), some movements drive the displacement into the binding window 188, where the bindings absorb the displacement prior to disengagement (ski falls off). Within the adjustment window, as displacement increases, the absorbed plate load increase until a release occurs, prior to (preferably) the injury threshold at window 190, in window 189. The adjustment window allows the release threshold to be set low enough that the plate 110 releases before the bindings, in which case ski boot disengagement occurs via plate 110 pivot as in FIG. 4, rather than binding 112, 114 disengagement (typically at the toe binding 112).

Figure 6:
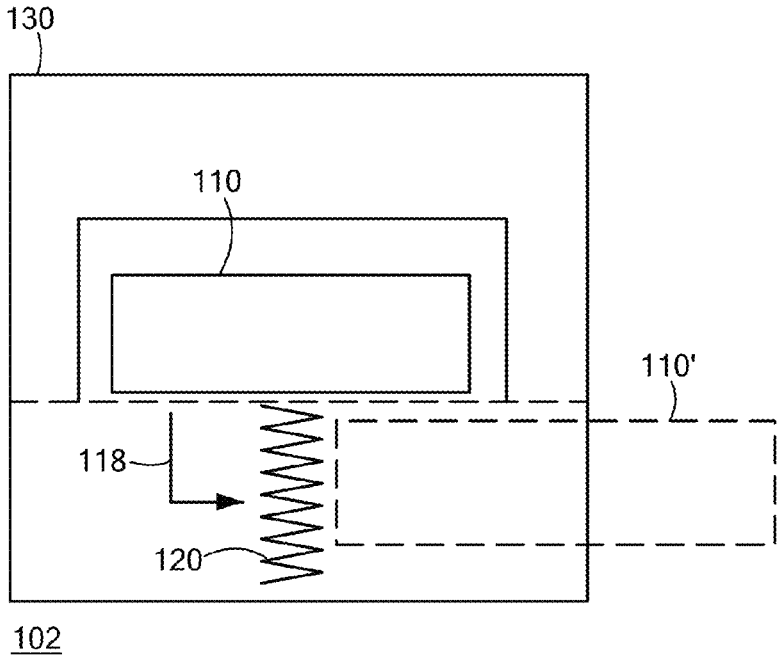
FIG. 6 shows an end view of the restrictor of FIGS. 1-4.

FIG. 6 shows an end view of the restrictor of FIGS. 1-4. Referring to FIGS. 2, 3 and 6, a particular engagement and release is shown; alternatives are also discussed in FIGS. 8*a* and 8*b*. In FIG. 6, the restrictor 130 engages the plate 110 by upward force from the spring 120 which maintains the plate engaged in the cavity defined by the restrictor. As the spring 120 compresses, in response to backweighting, the plate 110 pivots downward sufficiently to clear the restrictor 130 and pivots into position 110', as shown by arrow 118, allowing the boot to pivot outward at the heel 114. The outward pivot of the heel 114 is centered on a toe pivot 140, such that the toe pivot 140 is configured to permit upward displacement and release of the heel 114 while remaining attached at the toe 112 while permitting rotation around the toe pivot 140, i.e. the toe pivot 140 does not release the toe as a conventional binding. Therefore, backweighting is detectable from pivotal displacement of the boot heel 114 relative to the boot toe 112. As disclosed further below, the relative displacement may be either from the heel 114 displaced toward the ski 102 or from the toe 112 raised upwards from the ski 102

Figure 7A:
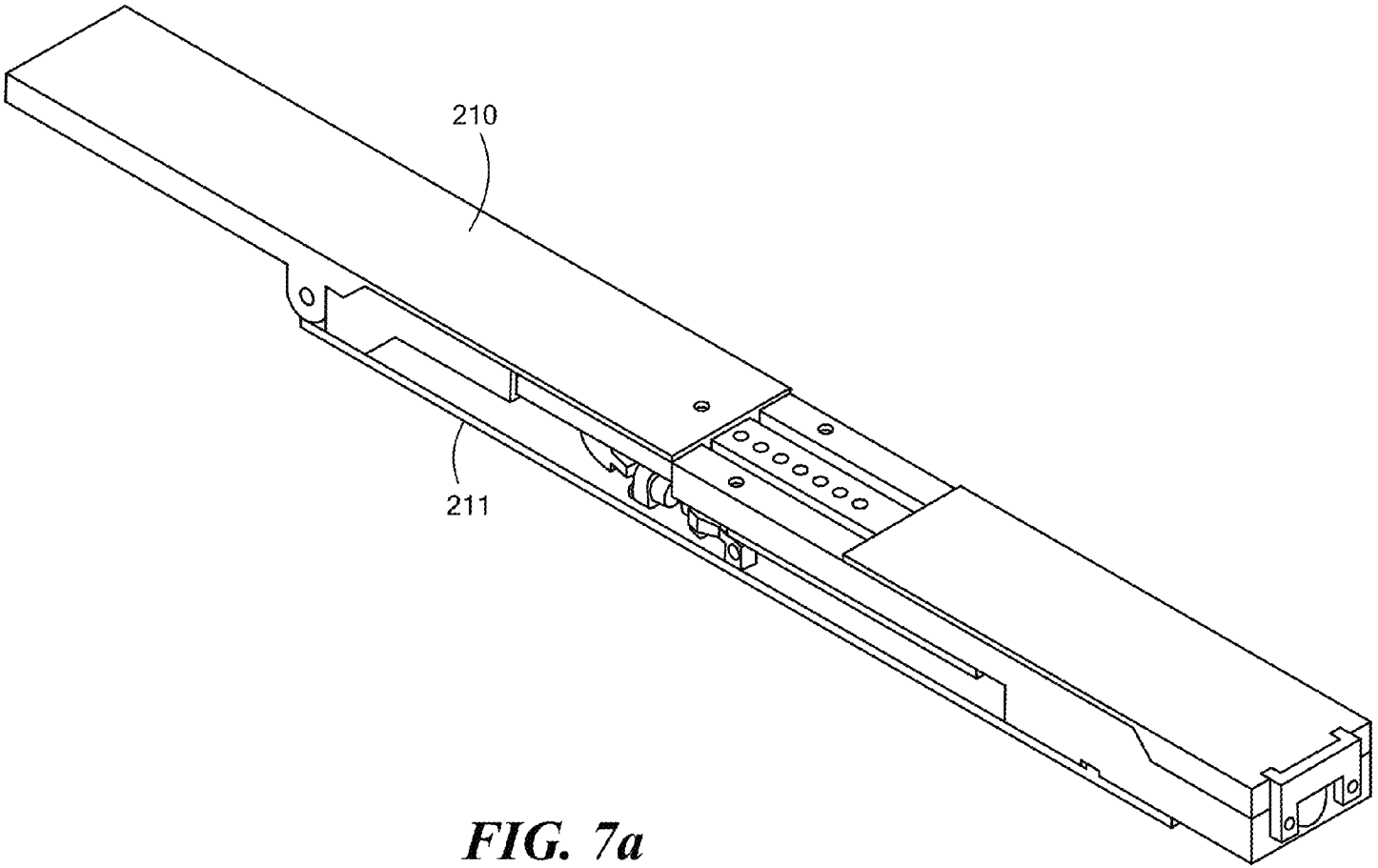
FIGS. 7*a*-7*c* show an alternate configuration of the ski binding plate device.
Figure 7B:
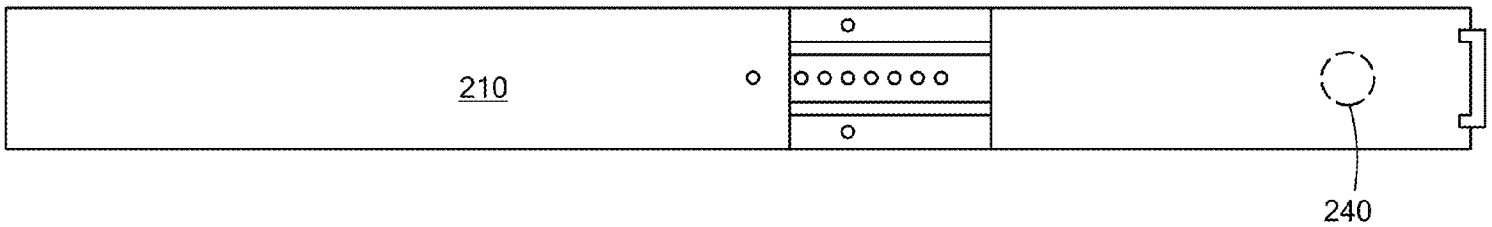
Figure 7C:
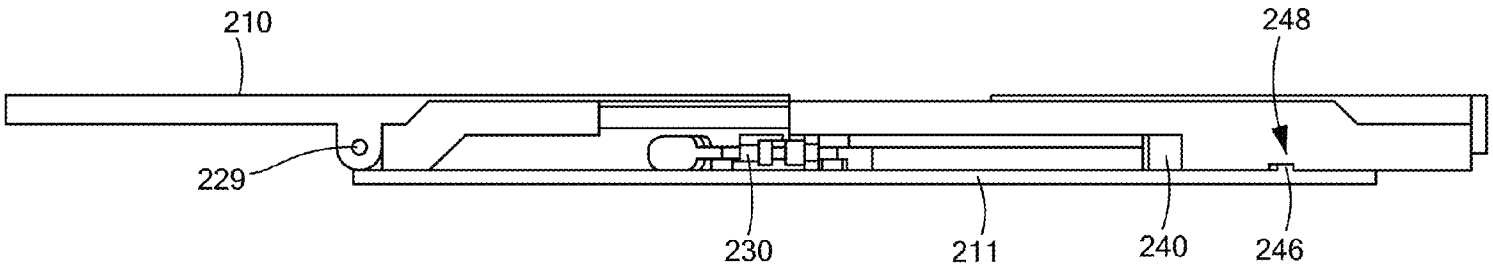

FIGS. 7*a*-7*c* show an alternate configuration of the ski binding plate device 110. Referring to FIGS. 1-3 and 7*a*-7*c*, the alternate configuration looks to toe 112 displacement upwards, rather than heel 114 displacement downwards, for identifying the release threshold. The top plate 210 mounts on top of a bottom plate 211, which has a toe pivot 240. A restrictor 230, shown in detail in FIGS. 8*a*-8*b*, activates (releases) upon sufficient upward pivot of the plate 210 around the horizontal pivot point 232.

Figure 8A:
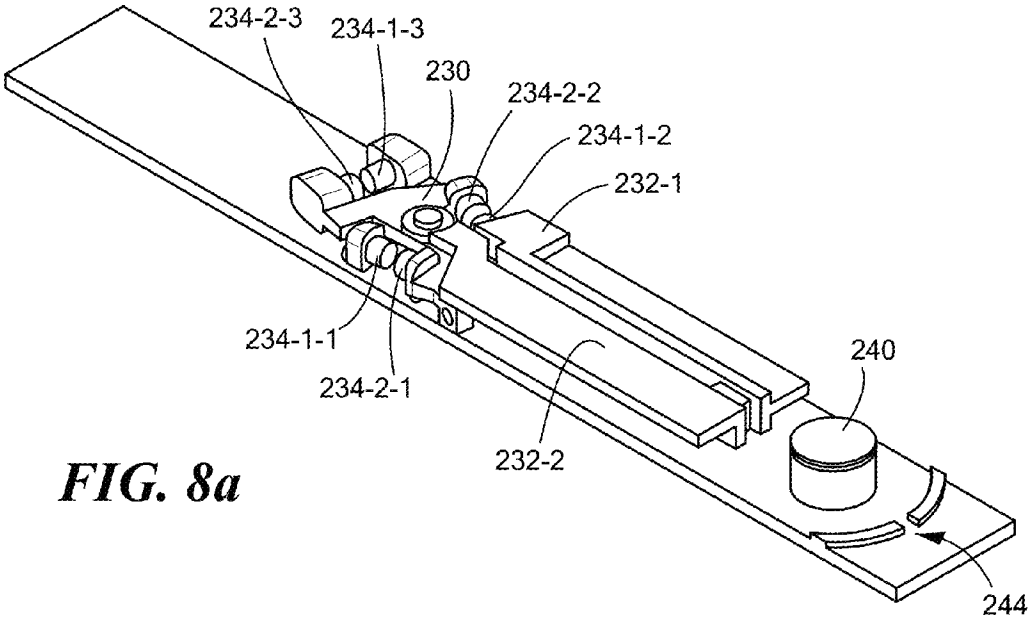
FIGS. 8*a*-8*b* show the restrictor in the configuration of FIGS. 7*a*-7*c;*
Figure 8B:
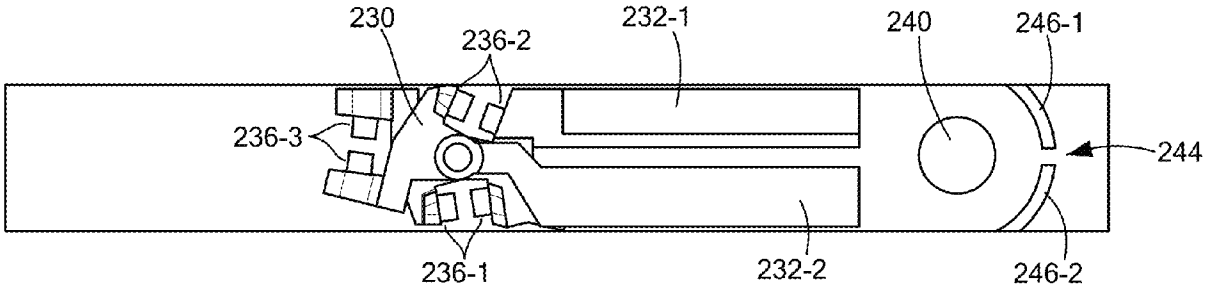

FIGS. 8*a*-8*b* show the restrictor in the configuration of FIGS. 7*a*-7*c*. Referring to FIGS. 7*a*-8*b*, the toe pivot 240 defines a shaft surrounded by right and left protrusions 246-1, 246-2 (246 generally) with a gap 244 at a center point between them. The center point defines the fixed position of the top plate 210, and a detent 248 on the plate 210 engages between the protrusions 246 for fixation at the center position. Pivot 229 permits the plate 210 to displace upward sufficiently to release the detent 248 from between the protrusions 246 and allow the heel 114 to pivot outward. It should be noted that the pivot 240 remains engaged to the plate such that the toe 112 rotates but does not disengage or detach.

Once the toe 112 rises sufficiently such that the detent 248 clears the protrusions 246, the heel 114 is free to pivot outward around the pivot point 240. The restrictor 230 further includes a plurality of resistance arms 232, such that each resistance arm 232 is responsive to a direction of outward heel displacement. Resistance arms 232-1, 232-2 (232 generally) operate to provide gradually decreasing resistance to the outward pivotal displacement of the heel 114. In the example shown in FIGS. 8*a* and 8*b*, the plurality of resistance arms 232 is defined by a parallel pair of opposed resistance arms 232-1, 232-2, such that each resistance arm has at least one spring arm 234 (generally) for opposing outward displacement of the resistance arms 232. The spring arms 234 include opposed pairs each connected to a respective resistance arm 232 such that outward displacement (movement) by the resistance arm 232 drives the spring arm 234 toward the opposed spring arm 234 of the other resistance arm 232. Each resistance arm 232 has 3 spring arms **234-*n*-1 . . . 234-*n*-3; the opposed pairs include 234-1-1 and 234-2-1; 234-1-2 and 234-2-2; 234-1-3 and 234-2-3. Each opposed pair of spring arms also includes a pair of opposed plungers 236-1 . . . 236-3 (236 generally), such that each plunger 236 extends from a corresponding spring arm 234 and is adapted to receive a spring, such that the spring engages the opposed plunger 236 on the opposed resistance arm 232**.

Figure 9:
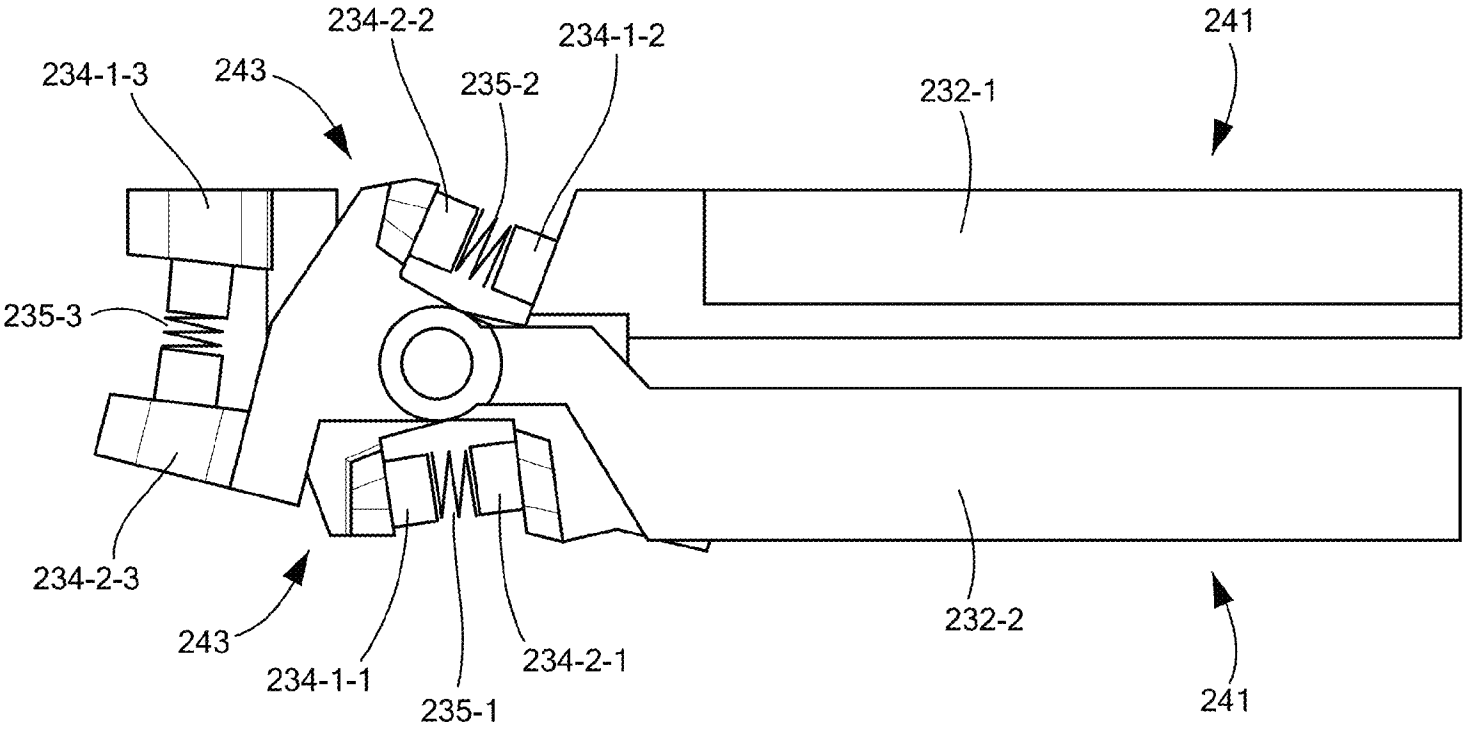
FIG. 9 show a plan view of the restrictor of FIGS. 7*a*-8*b;*
Figure 10:
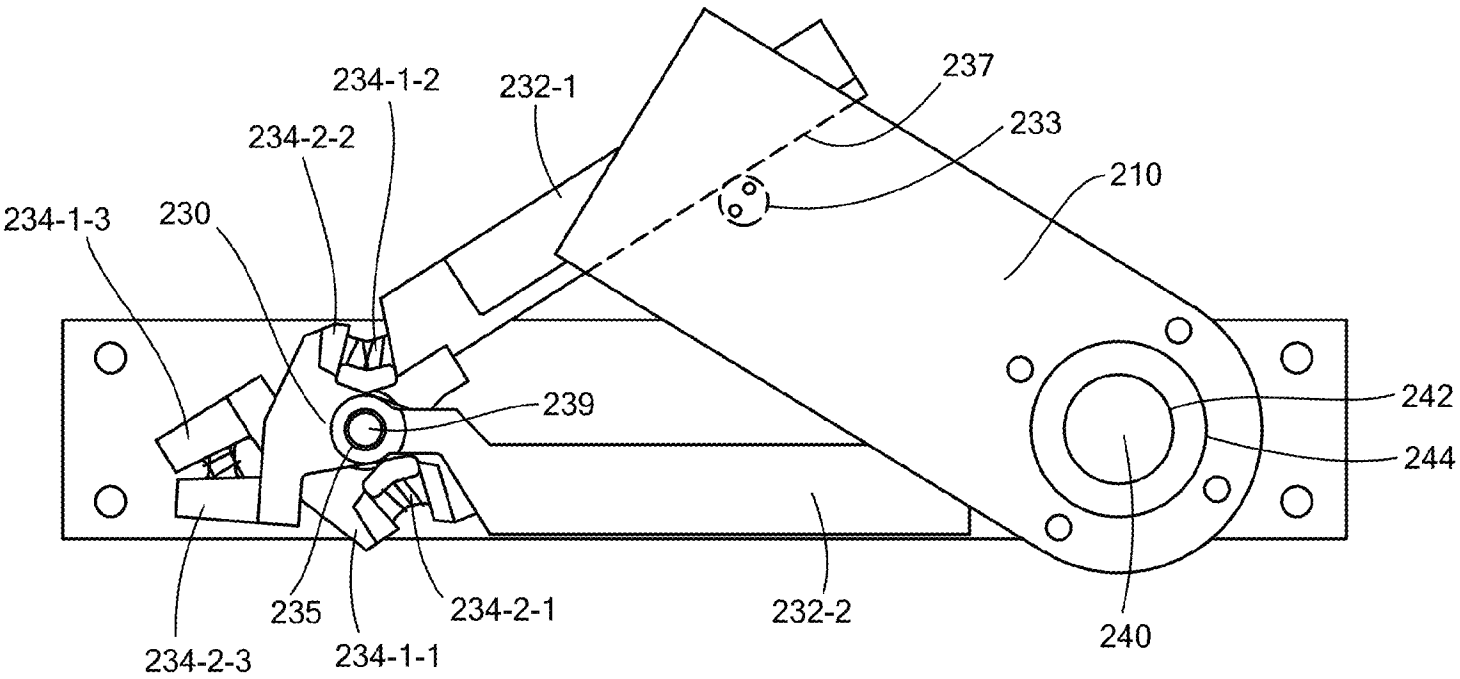
FIG. 10 show a plan view of the deployed device of FIG. 9.

FIG. 9 show a plan view of the restrictor of FIGS. 7*a*-8*b*, and FIG. 10 shows a plan view of the deployed device of FIGS. 7*a*-9. Referring to FIGS. 7*a*-10, each plunger 236 engages a spring 235-1 . . . 235-3 (235 generally) between opposed spring arms 234 for resisting outward pivotal movement by the resistance arm 232. The top plate 210 includes a fulcrum 233 such as a pin or roller for engaging the resistance arm 232 by the top plate 210 as it pivots outward. The resistance arms 232 and fulcrum 233 therefore define a slider-crank linkage pin or roller on the underside of the top plate 210 that slideably engages along the side 237 of the resistance arm 232 as the top plate 210 and heel 114 rotate outward. The fulcrum 233 of the rotating top plate 210 is fixed relative to the top plate 210, but moves outward on the resistance arm 232 relative to the restrictor 230 centerpoint 239.

Upon sufficient displacement of the toe (upwards), the top plate 210 rotates to pivot the heel 114 outward as the plate 210 rises up on the pivot 240 but does not disengage a receptacle 244 on the underside of the top plate 210. As the plungers 234 compress the springs 235, the fulcrum 233 slideably engages the inside edge 237 of the resistance arm 232, thus allowing further displacement and outward pivot with less resistance. In effect, this would generate a curve in the force diagram of FIG. 5, such that the force required to pivot the heel outwards increases at a lower rate once the displacement threshold is reached.

Therefore, each resistance arm 232 has an engagement portion at a distal end 241 from a rotation point 239, such that the engagement portion is adapted for slideable engagement with the fulcrum 233 on the pivot plate 210, and a resistance portion 243 at a proximate end, the resistance portion 243 having a plurality of plungers 236, such that each spring arm 134 is configured for resistive engagement with an opposed plunger 236 on the opposed resistance arm 232.

The resistance arms 232 are configured to provide decreasing resistance to the outward pivot by the heel 114, such that the decreasing resistance results from a pin defining the fulcrum 233 sliding outward on the resistance arm 232 as the pivot around the toe 112 at pivot point 240 increases.

Figure 11:
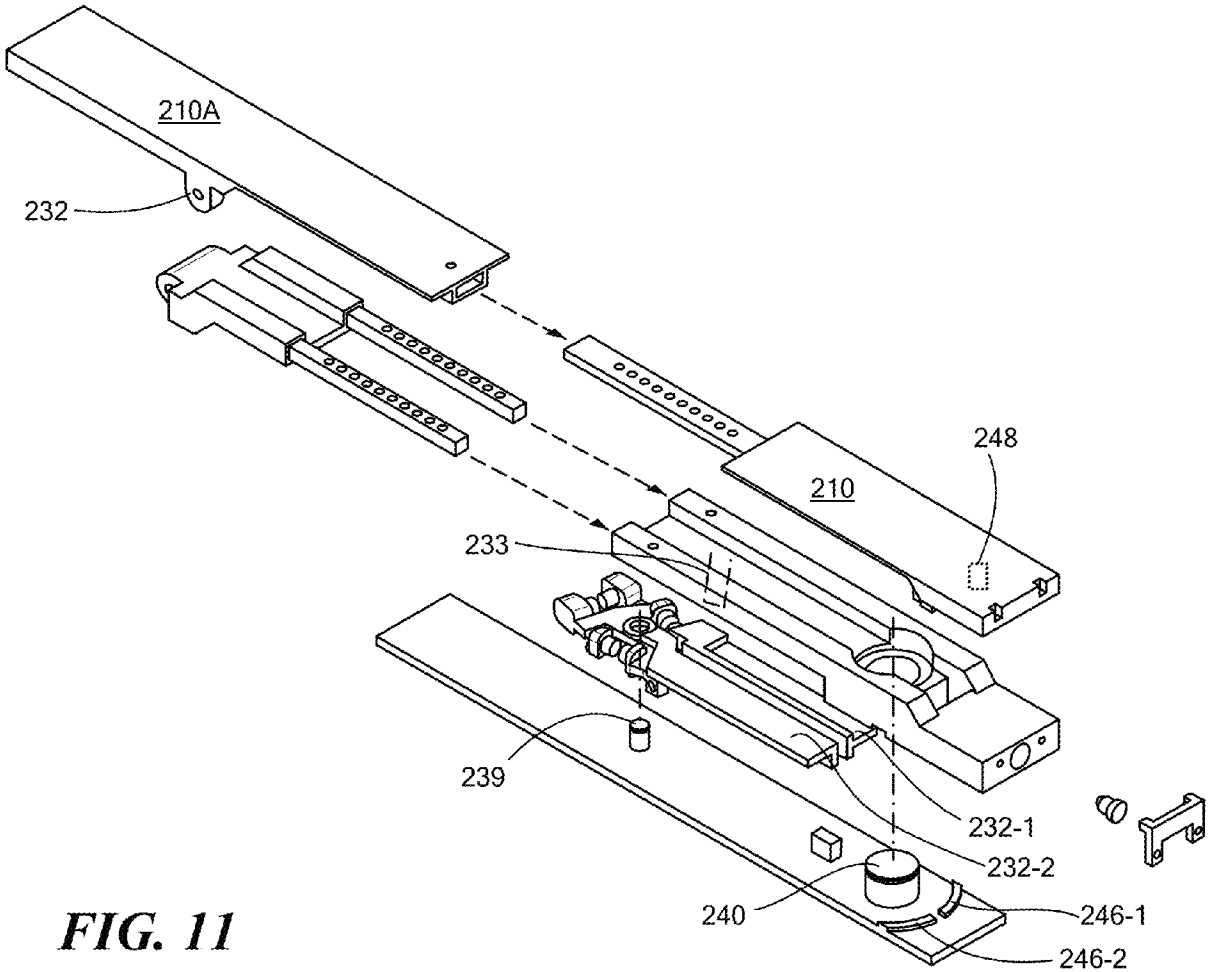
FIG. 11 shows an exploded view of the device of FIGS. 7*a*-9.

FIG. 11 shows an exploded view of the device of FIGS. 7*a*-10. Referring to FIGS. 7*a*-11, the top plate 210 includes an expandable section 210A for matching to the ski boot and binding 112, 114 combination. The collective top plate 210, 210A pivots upward around pivot point 232, which acts as a hinge, to release the toe 112 by raising the detent 248 above the protrusions 246 to rotate around the pivot 240 and allow the top plate 210 and boot to displace outward from the heel 114, remaining pivotally anchored at the toe (top plate 210 rises above the bottom portion 111, which remains level with the ski 102 around the pivot point 240). The fulcrum 233 displaces the resistance arm 232 outward, causing the restrictor 230 to rotation around center point 239 and advance the fulcrum along the edge 237 of the resistance arm 232.

Configurations herein further define a method performed by the disclosed binding plates 110 and 210, in which a method for disengaging a ski binding includes disengaging a heel 114 boot portion for permitting an outward pivot of the heel boot portion upon detecting a back-weighting above a threshold force. The device detects backweighting by sensing displacement of the heel 114 boot portion relative to the toe 112, in which displacement is countered by resistive force defined by an injury threshold. Typically a spring, cable, or hydraulic mechanism provides tension or compression for resisting forces below the threshold force to avoid premature deployment. Upon backweighting forces attaining the threshold force, the device permits upward movement of the toe 112 responsive to the threshold force, thus releasing the heel 114 for outward pivoting around the toe pivot point 240. The device applies gradually diminishing resistance to the outward heel rotation, such that resistance diminished based on the outward distance of the toe. In other words, a relatively large twisting force is required to begin outward heel displacement, and a lesser force needed to continue outward pivotal displacement. This is because once the injury threshold is attained, further damage can occur if the twisting force on the knee is not abated.

While the system and methods defined herein have been particularly shown and described with references to embodiments thereof, it will be understood by those skilled in the art that various changes in form and details may be made therein without departing from the scope of the invention encompassed by the appended claims.

What is claimed is:

1. A ski binding device, comprising:

a boot pivot adapted to permit pivotal movement of a ski boot relative to a top surface of a ski, the boot having a heel and a toe;

a restrictor operable to restrict lateral movement of the boot until a predetermined upward pivot displacement has been attained; and a toe pivot for allowing outward movement of the heel of the boot following upward displacement of the toe relative to the heel beyond the predetermined upward pivot displacement while maintaining attachment to the ski.

2. The device of claim 1 wherein the restrictor is configured to release the boot for outward pivot of the heel around the toe upon sufficient pivotal movement of the toe relative to the heel.

3. The device of claim 2 wherein the outward pivot is centered on a toe pivot, the toe pivot configured to permit upward displacement and release of the heel while remaining attached at the toe.

4. The device of claim 3 wherein backweighting is detectable from pivotal displacement of the boot heel relative to the boot toe.

5. The device of claim 1 wherein the restrictor further comprise a backweighting threshold, the restrictor adapted to detect a backweighting in excess of the backweighting threshold and release the boot for lateral movement around the toe pivot responsive to the excess backweighting.

6. The device of claim 5 wherein the restrictor further comprises a plurality of resistance arms, each resistance arm responsive to a direction of outward heel displacement.

7. The device of claim 6 wherein the plurality of resistance arms comprises a parallel pair of opposed resistance arms, each resistance arm having at least one spring arm for opposing outward displacement of the resistance arms.

8. The device of claim 6 wherein each resistance arm has an engagement portion at a distal end from a rotation point, the engagement portion adapted for slideable engagement with a fulcrum on the pivot plate, and a resistance portion at a proximate end, the resistance portion having a plurality of plungers, each spring arm configured for resistive engagement with an opposed plunger on the opposed resistance arm.

9. The device of claim 8 further comprising a pair of opposed plungers, each plunger extending from a corresponding resistance arm and adapted to receive a spring, the spring engaging the opposed plunger on the opposed resistance arm.

10. The device of claim 8 wherein the resistance arms are configured to provide decreasing resistance to the outward pivot by the heel, the decreasing resistance resulting from a pin defining the fulcrum sliding outward on the resistance arm as the pivot around the toe increases.

11. A method for disengaging a ski binding, comprising:

disengaging a heel boot portion for permitting an outward pivot of the heel boot portion upon detecting a backweighting above a threshold force, the backweighting defined by disproportionate vertical heel forces, further comprising detecting backweighting by sensing displacement of the heel boot portion relative to a toe boot portion, displacement countered by resistive force defined by an injury threshold.

12. The method of claim 11 further comprising:

permitting upward movement of the toe responsive to the threshold force;

releasing the heel boot portion for outward pivoting around a toe pivot point; and applying gradually diminishing resistance to the outward heel rotation, resistance diminished based on the outward distance of the toe boot portion.

13. A ski binding plate comprising:

a plate adapted to engage the ski binding, the plate having a heel end and a toe end;

a heel absorption mechanism adapted to absorb excessive lateral pivoting force from the heel of a ski boot;

a heel receptacle adapted to engage the heel end;

a vertical displacement moderator for biasing the heel into engagement with a heel receptacle; and a dual pivot engaging the toe end of the plate, the dual pivot for permitting downward movement of the heel end and lateral movement of the heel end out of alignment with the ski based on downward movement of the heel relative to the toe.

14. The ski binding plate of claim 13 wherein the vertical displacement moderator is responsive to downward force from the heel end toward the ski, the downward force resulting from disproportionate backweighting of a skier, the vertical displacement moderator disengaging the heel end from the heel receptacle based on a predetermined release force.

15. The ski binding plate of claim 13 wherein the dual pivot is responsive to permit lateral outward displacement of the heel end upon disengagement of the heel end.

16. The ski binding plate of claim 15 wherein the vertical displacement moderator permits lateral movement once the plate is released from the heel receptacle, the vertical displacement monitor disposing the heel end into engagement with the heel receptacle and adapted to selectively disengage the heel end upon a predetermined release threshold of force applied to the heel toward the ski.

17. The ski binding plate of claim 16 wherein the vertical displacement moderator further comprises at least one of a spring, hydraulic, pneumatic, or resilient material adapted to provide the predetermined release threshold.

18. The ski binding plate of claim 17 wherein the vertical displacement moderator is adapted to exhibit a flat force vs. displacement response curve.

19. The ski binding plate of claim 13 wherein the heel end is engaged with the heel receptacle when biased by the vertical displacement moderator.

20. The ski binding plate of claim 13 wherein the plate is adapted to engage a ski binding at a toe and a heel end, the binding plate secured to a ski boot such that release operation of the ski binding is not impeded.

21. The ski binding plate of claim 13 wherein the plate further comprises a bottom plate hingedly attached to the top plate via a hinge disposed at a heel end of the binding plate, and the toe end is adapted to selectively disengage according to a predetermined force of the ski away from the toe end.

* * * * *